US011248349B2

(12) United States Patent
Cox et al.

(10) Patent No.: US 11,248,349 B2
(45) Date of Patent: Feb. 15, 2022

(54) PAD FOR A RAILWAY RAIL FASTENING ASSEMBLY

(71) Applicant: Pandrol Limited, Surrey (GB)

(72) Inventors: Stephen John Cox, Surrey (GB); Robert John Hamilton, Surrey (GB)

(73) Assignee: Pandrol Limited, Surrey (GB)

( * ) Notice: Subject to any disclaimer, the term of this patent is extended or adjusted under 35 U.S.C. 154(b) by 357 days.

(21) Appl. No.: 16/330,291

(22) PCT Filed: Apr. 12, 2017

(86) PCT No.: PCT/GB2017/051015
§ 371 (c)(1),
(2) Date: Mar. 4, 2019

(87) PCT Pub. No.: WO2018/060668
PCT Pub. Date: Apr. 5, 2018

(65) Prior Publication Data

US 2019/0203424 A1 Jul. 4, 2019

(30) Foreign Application Priority Data

Sep. 30, 2016 (GB) ..... 1616608

(51) Int. Cl.
*E01B 9/68* (2006.01)

(52) U.S. Cl.
CPC ..... *E01B 9/683* (2013.01); *E01B 9/685* (2013.01); *E01B 9/688* (2013.01)

(58) Field of Classification Search
CPC ..... E01B 9/683; E01B 9/685; E01B 9/688; E01B 9/68; E01B 9/681; E01B 9/686;
(Continued)

(56) References Cited

U.S. PATENT DOCUMENTS 2,397,023 A 3/1946 Lloyd
3,826,424 A 7/1974 McClung et al.
(Continued)

FOREIGN PATENT DOCUMENTS

DE 2745220 A1 4/1979
EP 0620317 A1 10/1994
(Continued)

OTHER PUBLICATIONS

International Search Report received in corresponding PCT Application No. PCT/GB2017/051015, completed Jul. 11, 2017 dated Jul. 20, 2017.

(Continued)

*Primary Examiner* — Zachary L Kuhfuss
*Assistant Examiner* — Cheng Lin
(74) *Attorney, Agent, or Firm* — Vorys, Sater, Seymour and Pease LLP

(57) ABSTRACT

A pad for a railway rail fastening assembly, the pad being configured for placement between a rail and an underlying foundation, such as slab track or a sleeper, wherein a cross-section of the pad comprises: a second resilient layer configured to face a railway rail; an intermediate rigid layer; and a first resilient layer configured to face an underlying foundation. The rigid layer is provided between and is integrally formed with the first and second resilient layers. An edge of the pad comprises at least one ear that extends beyond a central region of the pad, the rigid layer extending into the ear with the ear being configured to resist rail roll.

20 Claims, 11 Drawing Sheets

(58) Field of Classification Search
CPC ... E01B 9/62; E01B 9/303; E01B 9/42; E01B 19/003
USPC ..... 238/283
See application file for complete search history.

(56) References Cited

U.S. PATENT DOCUMENTS

| | | | | | |
|---|---|---|---|---|---|
| 4,773,591 | A * | 9/1988 | Sonneville | E01B 9/685 | 238/265 |
| 4,907,740 | A * | 3/1990 | Oberweiler | E01B 9/685 | 238/283 |
| 5,261,599 | A | 11/1993 | Brown | | |
| 5,335,850 | A | 8/1994 | Igwemezie | | |
| 5,361,986 | A | 11/1994 | Meier et al. | | |
| 6,386,461 | B1 * | 5/2002 | Wildgoose | E01B 9/68 | 238/283 |
| 6,761,322 | B1 * | 7/2004 | Porrill | E01B 9/483 | 238/264 |
| 7,690,584 | B2 * | 4/2010 | Geissele | E01B 9/303 | 238/264 |
| 9,410,294 | B2 * | 8/2016 | Harkness | E01B 9/40 | |
| 9,903,074 | B2 * | 2/2018 | Cox | E01B 9/66 | |
| 2004/0121096 | A1 * | 6/2004 | Asmussen | E01B 19/003 | 428/34.1 |

FOREIGN PATENT DOCUMENTS

| | | | | |
|---|---|---|---|---|
| GB | 1029247 | A | 5/1966 | |
| GB | 2114635 | A * | 8/1983 | E01B 9/683 |
| GB | 2114635 | A | 8/1983 | |
| GB | 2237833 | A | 5/1991 | |
| JP | H11-323801 | A | 11/1999 | |
| RU | 2287038 | C2 | 11/2006 | |
| WO | 1998/041690 | A1 | 9/1998 | |
| WO | 2013/123987 | A1 | 8/2013 | |

OTHER PUBLICATIONS

Written Opinion received in corresponding PCT Application No. PCT/GB2017/051015 dated Jul. 20, 2017.
Search Report received in corresponding GB Application No. GB1616608.4 dated Mar. 9, 2017.
Search Report received in corresponding SG Application No. 11201902360Q, completed Jul. 28, 2020.

* cited by examiner

PAD FOR A RAILWAY RAIL FASTENING ASSEMBLY

The present invention relates to a pad for a railway rail fastening assembly.

BACKGROUND

In railway track fastening applications, an important parameter associated with a track fastening is its vertical stiffness. In some situations it is desirable to have a track fastening with a low stiffness, e.g. to reduce vibration or noise. This is particularly the case in slab track applications (i.e. those without ballast), as there is no ballast to provide additional resilience.

Track fastening assemblies typically comprise a resilient rail pad provided between the rail and the underlying foundation (e.g. slab or sleeper). The stiffness of such a rail pad may be reduced to provide a softer track fastening. However, as the pad stiffness gets lower, the amount of undesirable rail roll that is generated in response to an inclined load also increases. The problem with rail roll is that it can change the position of the critical contact between the wheel and rail and lead to poor vehicle steering characteristics. As a result, the train may lurch from side to side or impart excessive forces on the track.

To obtain a lower vertical stiffness, a baseplate may be introduced into the fastening system. Such a baseplate may spread the load and better resist the moment that leads to rail roll. However, introducing a baseplate adds significantly to the cost and weight of the rail fastening system, for example due to the addition of the baseplate and the larger baseplate pad that fits beneath it. Rail fastening system with such baseplates also become more complicated, with more components.

Accordingly, a rail fastening assembly that can provide low stiffness without an expensive or heavy baseplate is desirable.

STATEMENTS OF INVENTION

According to an aspect of the present invention there is provided a pad for a railway rail fastening assembly, the pad being configured for placement between a rail and an underlying foundation, wherein a cross-section of the pad comprises:

a rigid layer; and a first resilient layer configured to face, e.g. contact, an underlying foundation, wherein the rigid layer is integrally formed with the first resilient layer.

An edge of the pad may comprise (e.g. form) at least one ear (e.g. lug or projection) that extends beyond a central region of the pad (e.g. in substantially the same plane as the pad). The rigid layer may extend into the ear. The ear may be configured to resist rail roll.

The pad may further comprise a second resilient layer configured to face a railway rail. The rigid layer may be provided between the first and second resilient layers. The rigid layer may be integrally formed with the first and second resilient layers.

Such a pad may advantageously combine the functions of previously-proposed baseplate pads, baseplates and rail pads. Accordingly, such a pad is cheaper and simpler than a conventional baseplate assembly, which might otherwise be necessary. Furthermore, the pad according to the present invention may behave more like a baseplate, so allowing softer pads in standard assemblies. In particular, the pad according to the present invention may reduce the amount of rail roll associated with soft rail pads.

The rigid layer may be encapsulated, e.g. substantially or completely encapsulated, within the first and second resilient layers.

At least one of the first and second resilient layers may extend over one or more edges of the rigid layer. For example, in the case of the second resilient layer not being provided, the first resilient layer may extend over (e.g. alongside) one or more edges of the rigid layer, e.g. such that the rigid layer is embedded in the first resilient layer. In the case of the second resilient layer being provided, the first and second resilient layers may be connected at said edges of the rigid layer, e.g. so as to encapsulate the rigid layer.

The first and second resilient layers may be unitary with each other. The first and second resilient layers may be made from the same material.

The first and second resilient layers may be connected at one or more cross sections at which the rigid layer is not provided, for example at the edges of the pad and/or other regions away from the edges of the pad.

The rigid layer may be embedded in the first resilient layer. The first resilient layer and the rigid layer may be molded together. The first and second resilient layers may be molded around the rigid layer. Additionally or alternatively, the first and/or second resilient layers may be bonded to the rigid layer.

At least the rigid layer may be sized so as to extend beyond the width of a base, e.g. foot, of the rail. For example, the rigid layer may be wider than a particular standard rail, such as those set out in European standard, EN13674. In particular, the rigid layer may be wider than standard rail profile 60E1, which has a foot width of 150 mm. The rigid layer may extend between anchoring devices of the fastening assembly.

The rigid layer may comprise first and second rigid layer portions spaced apart from each other, e.g. laterally spaced apart. (The lateral spacing may be in the same direction as the longitudinal axis of the rail.) The first and second rigid layer portions may be separate from one another so as to form discrete portions. In other words, the rigid layer may be absent in the space between the first and second rigid layer portions (where it cannot protrude out beyond the rail width because of the presence of anchoring devices that locate corresponding rail clips). Alternatively, the first and second rigid layer portions may be connected by a connecting portion. In either case, the first and second rigid layer portions may be provided at the same intermediate position across the thickness of the pad.

The first and second rigid layer portions may be elongate, e.g. forming strips. The first and second rigid layer portions may extend in substantially the same direction. The first and second rigid layer portions may extend in a longitudinal direction of the pad, e.g. in a direction perpendicular to the lateral spacing between the first and second rigid layer portions. (Accordingly, the longitudinal direction of the pad may be perpendicular to the longitudinal axis of the rail.)

The rigid layer may reduce rail roll by extending out beyond the rail foot. Therefore, the cost may be reduced and the same effect achieved by providing the first and second rigid layer portions, with no rigid layer present in the space between the first and second rigid layer portions.

The edge and an opposing edge of the pad may each comprise at least one ear that extends beyond the central region of the pad. For example, the edge and opposing edge may each comprise one ear. The ears may be diagonally opposite, e.g. offset from, each other.

At least one edge of the pad may have a pair of spaced apart ears (e.g. laterally spaced apart) that extend beyond the central region of the pad. In particular, opposing edges of the pad may each comprise a pair of spaced apart ears that extend beyond a central region of the pad. The ears may extend in the longitudinal direction of the pad (e.g. perpendicular to the rail longitudinal axis).

The rigid layer may extend into the ears, in particular, the first and second rigid layer portions may extend into corresponding ears. The first and second rigid layer portions may extend out almost to the ends of the ears, e.g. so that resistance to rail roll may be maximised. Each of the first and second rigid layer portions may extend between the said opposing edges.

The ears may comprise the first resilient layer. The ears may comprise the second resilient layer.

The pad may be asymmetric, e.g. about the pad's lateral axis, which may be parallel to the longitudinal axis of the rail when installed. The ear or pair of ears on one of the opposing edges may extend further from the central region than the ear or pair of ears on the other of the opposing edges. For example, longer ears may be provided on a field side of the pad and shorter ears may be provided on a gauge side of the pad.

The ear or pair of ears on one of the opposing edges may be wider (e.g. in the pad lateral direction) than the ear or pair of ears on the other of the opposing edges. For example, wider ears may be provided on the field side of the pad and narrower ears may be provided on the gauge side of the pad. The longer and wider ears may be provided on the same side of the pad. The longer and/or wider ears may be more effective at resisting rail roll and as a result they may be provided on the field side of the pad, as this is where the maximum downward force may be directed. The length and/or width of the ears may be adjusted to suit the desired stiffness.

The central region may be trapezoidal shaped. For example, a width (e.g. edge) of the central region from which one of the ears or pairs of ears extends may be wider than an opposite width (e.g. edge) of the central region, e.g. from which the other ear or pair of ears may extend. The wider central region width may have the longer and/or wider ears.

The central region may be sized to be substantially the same width as the base, e.g. foot, of the rail, for example the standard rails mentioned above. The ears may extend beyond the rail base.

The or each ear may be configured to extend alongside an anchoring device forming part of the fastening assembly. One or each pair of ears may be configured to extend either side of the anchoring device forming part of the fastening assembly. The ears from one or each pair may be configured to extend alongside the anchoring device (in particular on the field side) and may extend alongside a substantial portion of the anchoring device, e.g. at least beyond an insulator between the anchoring device and the rail. The ears may be configured not to extend beneath the anchoring device.

The anchoring device may be configured to receive a fastening means, such as a clip, which bears down on the rail when in an installed configuration. The anchoring device may be fixed to the underlying foundation, e.g. with the same or another fastening means.

The anchoring devices on either side of the rail may be independent of one another and may be independently connectable to the underlying foundation. For example, the fastening assembly, for which the pad of the present invention is intended, may not have a rigid (e.g. metal) baseplate, which engages or comprises the anchoring devices, and which extends beneath the rail.

The second resilient layer may be thicker in the central region than at the ears. The second resilient layer thickness transition may occur where the ears meet the central region of the pad. For example, the second resilient layer thickness transition may extend beneath an edge of the base of the rail intended for the pad. A chamfer may be provided in the second resilient layer where the thickness of the second resilient layer changes. The second resilient layer thickness transition may avoid the edge of the rail cutting in to the pad.

The first and second resilient layers may be configured so as to have different stiffnesses, for example the second resilient layer may be stiffer than the first resilient layer. The second resilient layer may be thinner than the first resilient layer. The first resilient layer may comprise a plurality of voids distributed across the first resilient layer so as to reduce the stiffness of the first resilient layer. For example, the first resilient layer may comprise a plurality of studs, projections, protrusions, grooves, channels, etc., which serve to reduce the area through which the loads from the rail are distributed.

The rigid layer may be formed from a metal, such as steel. The first and second resilient layers may be formed from the same or different resilient materials. At least one of the first and second resilient layers may be formed from rubber.

The underlying foundation may comprise a sleeper or a slab, e.g. as used in track slab application. The underlying foundation may be formed from concrete, cement, wood or any other suitable material.

The pad may be configured to be independent of a fastening that couples the rail to the underlying foundation and/or independent of a fastening between an anchoring device and the underlying foundation.

The rigid layer may have a rigidity that resists bending of the rigid layer during use of the rail.

The rigid layer may have a substantially flat surface facing the first resilient layer.

A railway rail fastening assembly may comprise the above-mentioned pad.

BRIEF DESCRIPTION OF THE DRAWINGS

Reference will now be made to the accompanying drawings in which:

FIG. 3*a* shows a side view, FIG. 3*b* shows a sectional view corresponding to section A-A depicted in FIG. 3*a* and FIG. 3*c* shows a sectional view corresponding to section B-B depicted in FIG. 3*a;*

DETAILED DESCRIPTION

Figure 1:
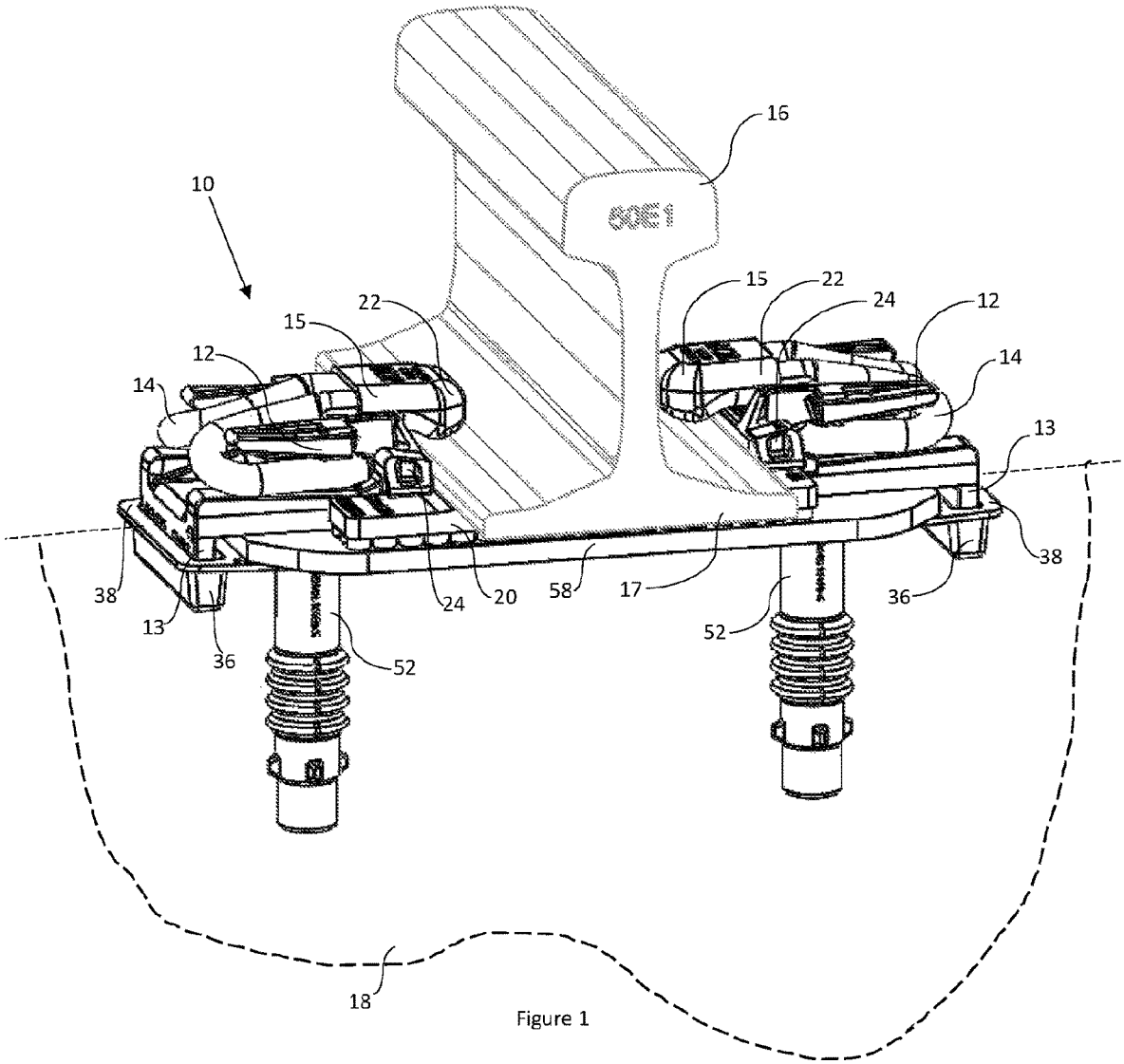
FIG. 1 is a perspective view of a railway rail fastening assembly.

With reference to FIG. 1, a railway rail fastening assembly 10, according to an example of the present invention, comprises an anchoring device 12, e.g. a shoulder, configured to receive a railway rail fastening clip 14. The anchoring device 12 is operatively connected to an underlying foundation (shown schematically in FIG. 1), such as a railway sleeper or slab. Respective anchoring devices 12 are provided on either side of a railway rail 16 for retaining clips 14 which bear on a rail base or foot 17. The clip 14 secures the railway rail 16 to the underlying foundation by virtue of forces exerted by the clip on the anchoring device 12 and the rail 16.

The clip 14 may be configured such that it can be deflected from a non-operative configuration to at least one operative configuration in which a toe portion 15 of the clip bears indirectly on the rail via a toe insulator 22, which is described in more detail below. (In an alternative arrangement, the toe insulator may be omitted such that the clip bears directly on the rail.) The clip 14 may be resilient and may be made from a rod of resilient material. The clip 14, as shown in FIG. 1, may be of the type that is inserted into engagement with the anchoring device 12 and rail 16 in a substantially lateral direction relative to a longitudinal axis of the rail. However, other clip types are also envisaged, e.g. clips that are inserted in a direction parallel to the longitudinal axis of the rail. Furthermore, although a particular anchoring device, which cooperates with a corresponding clip, is shown in FIG. 1, it is envisaged that the present invention may apply to any other type of anchoring device, clip and/or anchoring devices without clips.

The railway rail fastening assembly 10 may further comprise one or more electrically insulating wear pieces, such as the toe insulator 22 and a side post insulator 24. The toe insulator 22 may be carried by the toe portion 15 of the clip 14 and may bear against the rail foot 17 in an installed configuration. The toe insulator 22 may electrically insulate the rail from the clip and/or limit wear between the rail and the clip. The side post insulator 24 may be positioned between the anchoring device 12 and the rail foot 17 in an installed configuration and the side post insulator 24 may extend along the width of the anchoring device. The side post insulator 24 may electrically insulate the rail from the anchoring device and/or limit wear between the rail and the anchoring device.

Referring still to FIG. 1, each anchoring device 12 may comprises a protrusion 13 provided on a lower surface of the anchoring device, e.g. facing the underlying foundation when in the installed configuration. The anchoring device protrusion 13 may be configured to cooperate with a corresponding recess 36 provided in an intermediate member 38. The intermediate member 38 may extend beneath the rail 16 and may comprise a recess 36 at each end for receiving anchoring devices 12. (Alternatively, the intermediate member may not extend beneath the rail and separate intermediate member portions may be provided, each with a recess for receiving anchoring devices 12.) The cooperation of the anchoring device protrusion 13 with the recess may permit a substantially vertical adjustment of the anchoring device 12 relative to the underlying foundation 18.

The railway rail fastening assembly 10 may further comprise a fastening means (not shown), such as a bolt, for each anchoring device. The fastening means may be configured to fasten the anchoring device 12 to the underlying foundation 18. The fastening means may be received in corresponding fastening means receiving portions 52 in the underlying foundation 18. The fastening means receiving portions 52 may cooperate with the fastening means to secure the anchoring device 12 to the underlying foundation 18. The intermediate member 38 and fastening means receiving portions 52 may be cast into the underlying foundation 18.

The railway rail fastening assembly 10 may further comprise one or more optional spacing shims 58 configured for placement between the anchoring devices 12 and the underlying foundation 18 or intermediate member 38. The shim 58 may extend beneath the rail 16. As such, a pair of anchoring devices 12 either side of the rail may be placed on the same shim 58. The thickness of the shim 58 and/or number of shims may be varied to adjust the height of the anchoring devices 12 relative to the underlying foundation 18. The shim 58 may be securely located in the installed configuration thanks to one or more openings in the shim, through which the fastening means may pass. The shim 58 may be substantially flat on both sides.

The intermediate member 38, fastening means receiving portions 52 and/or shims may be formed of a plastic, such as a high viscosity nylon or any other suitable plastic.

The railway rail fastening assembly 10 may further comprise a pad 20 according to examples of the present invention. As will be described in more detail below, the pad 20 comprises resilient material for providing cushioning between the rail foot 17 and the underlying foundation 18. The railway pad 20 may be placed on the shim 58 in the event that a shim is provided.

With reference to FIGS. 2*a-b*, 3*a-c* and 4, the pad 20 according to a first example of the present invention will be described.

Figure 2A:
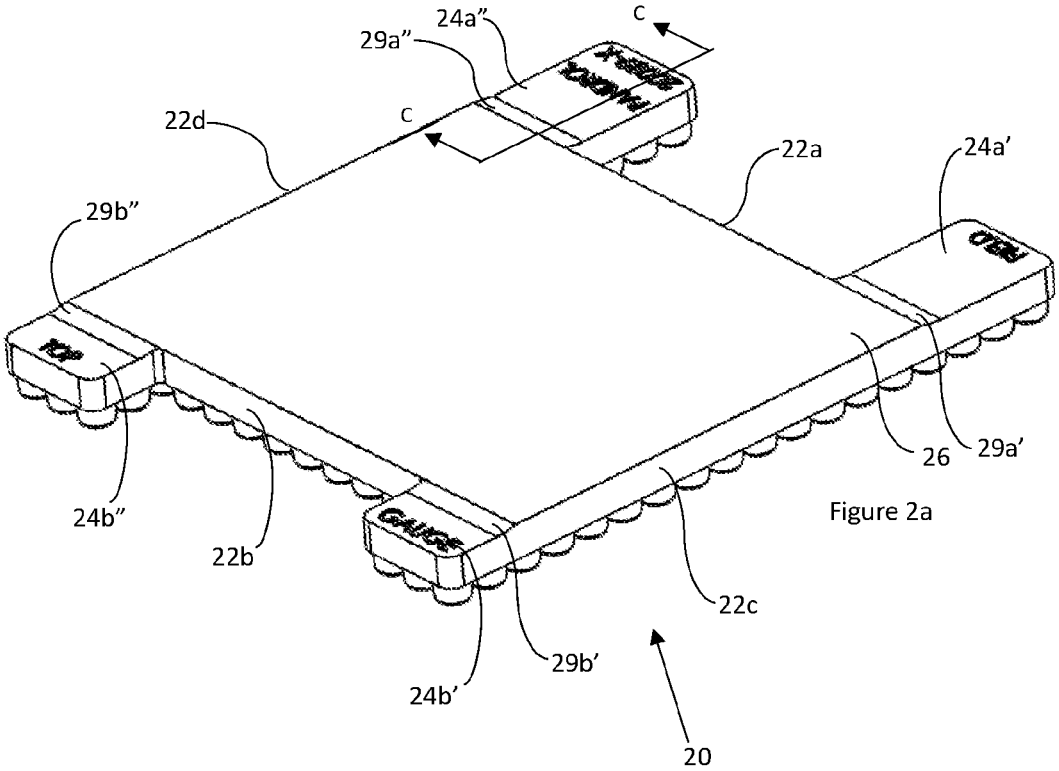
FIGS. 2*a* and 2*b* are perspective views of a pad for the railway rail fastening assembly according to a first example of the present invention with FIGS. 2*a* and 2*b* showing top and bottom perspective views respectively.
Figure 2B:
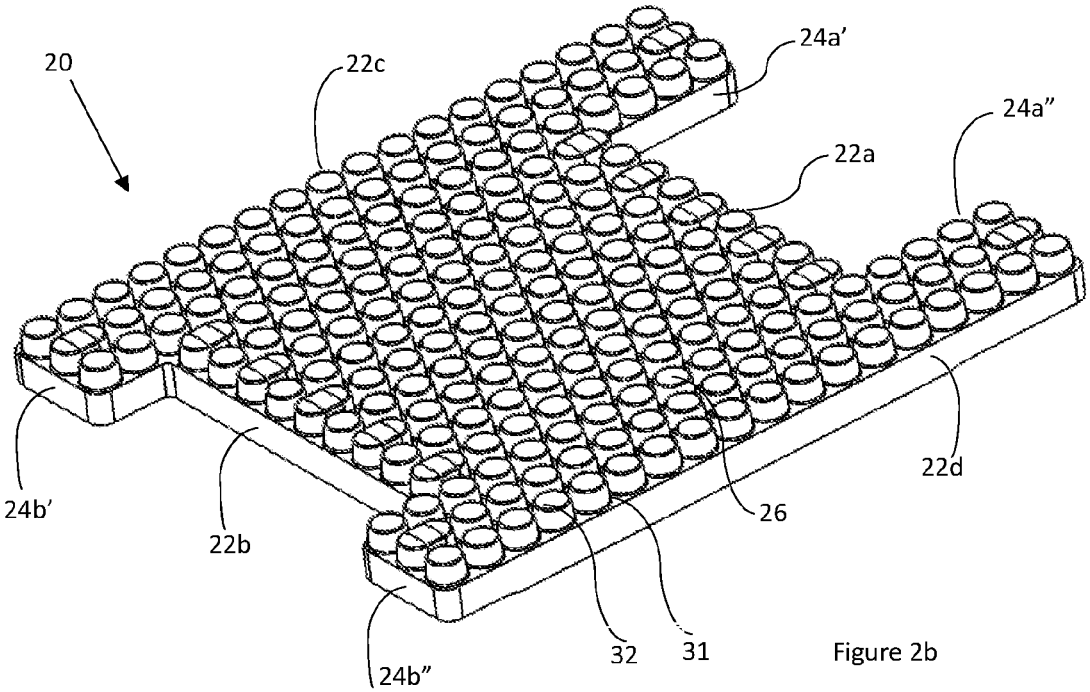

Referring now to FIGS. 2*a* and 2*b*, opposing edges 22*a*, 22*b* of the pad 20 may each have a pair of laterally spaced apart ears 24*a*', 24*a*"; 24*b*', 24*b*" that extend beyond a central region 26 of the pad. A first edge 22*a* may have ears 24*a*', 24*a*", whilst a second edge 22*b* may have ears 24*b*', 24*b*". The ears 24*a*', 24*a*", 24*b*', 24*b*" may extend in a longitudinal direction of the pad, which may be perpendicular to a longitudinal axis of the rail when the pad is installed. The ears on each edge 22*a*, 22*b* may be spaced apart in a lateral direction of the pad, which is perpendicular to the longitudinal direction of the pad.

The ears 24*a*', 24*a*" from the first edge 22*a* may line up with respective ears 24*b*', 24*b*" from the second edge 22*b*. Furthermore, edges of the ears 24*a*', 24*a*", 24*b*', 24*b*" may be continuous with corresponding edges 22*c*, 22*d* of the pad extending in the longitudinal direction of the pad.

The central region 26 may have a length (in the longitudinal direction of the pad) substantially the same as the width of the rail foot 17. As a result, the ears 24*a*', 24*a*"; 24*b*', 24*b*" may start extending from the central region 26 at the edge of the rail foot 17. The rail 16 may be a standard rail, such as those set out in European standard, EN13674. In particular, the rail 16 may have standard rail profile 60E1, which has a foot width of 150 mm.

The pad 20 may be asymmetric, e.g. about a lateral axis of the pad. (The pad lateral axis may be parallel to the longitudinal axis of the rail when installed.) For example, as depicted, the pair of ears 24*a*', 24*a*" from the first edge 22*a* may extend further from the central region 26 than the pair of ears 24*b*', 24*b*" from the second edge 22*b*. The longer ears 24*a*', 24*a*" may be provided on a field side of the pad 20 and shorter ears 24*b*', 24*b*" may be provided on a gauge side of the pad. (In an alternative example, the ears on the first edge 22*a* may have the same length as the ears on the second edge 22*b*.)

As depicted in FIG. 1, when the pad 20 is installed in the railway rail fastening assembly 10, each pair of ears 24*a*', 24*a*"; 24*b*', 24*b*" extends either side of a respective anchoring device 12. In other words, the lateral spacing of the ears may define a gap which receives the respective anchoring device 12. The ears 24*a*', 24*a*" at the first edge 22*a* (e.g. those on the field side) may extend alongside a substantial portion of the anchoring device 12, e.g. at least beyond the side post insulator 24 between the anchoring device 12 and the rail 16. By contrast, the ears 24*b*', 24*b*" at the second edge 22*b* (e.g. those on the gauge side) may extend alongside a smaller portion of the anchoring device 12 or just alongside the corresponding side post insulator 24.

The ears from each pair 24*a*', 24*a*"; 24*b*', 24*b*" extend alongside the respective anchoring device (or side post insulator 24) and the ears 24*a*', 24*a*"; 24*b*', 24*b*" may not extend beneath the anchoring device 12. As a result, the pad 20 may be installed after the anchoring devices 12 have been secured to the underlying foundation 18. In this way, the pad 20 may be independent of (e.g. not form part of) the fastening that secures the anchoring device 12 to the underlying foundation 18.

Figure 3A:
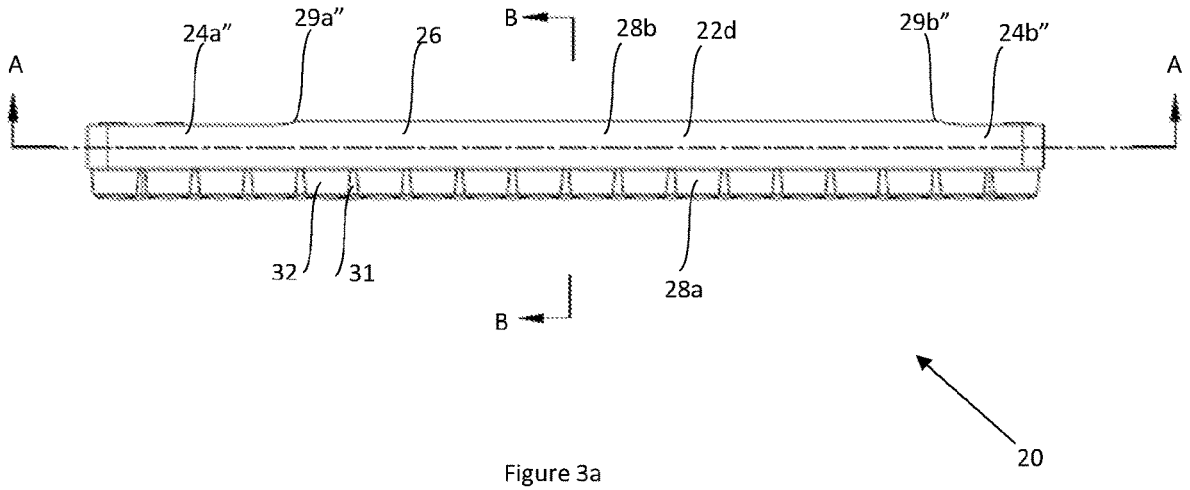
FIGS. 3*a*, 3*b* and 3*c* show further views of the pad for the railway rail fastening assembly according to the first example of the present invention where
Figure 3B:
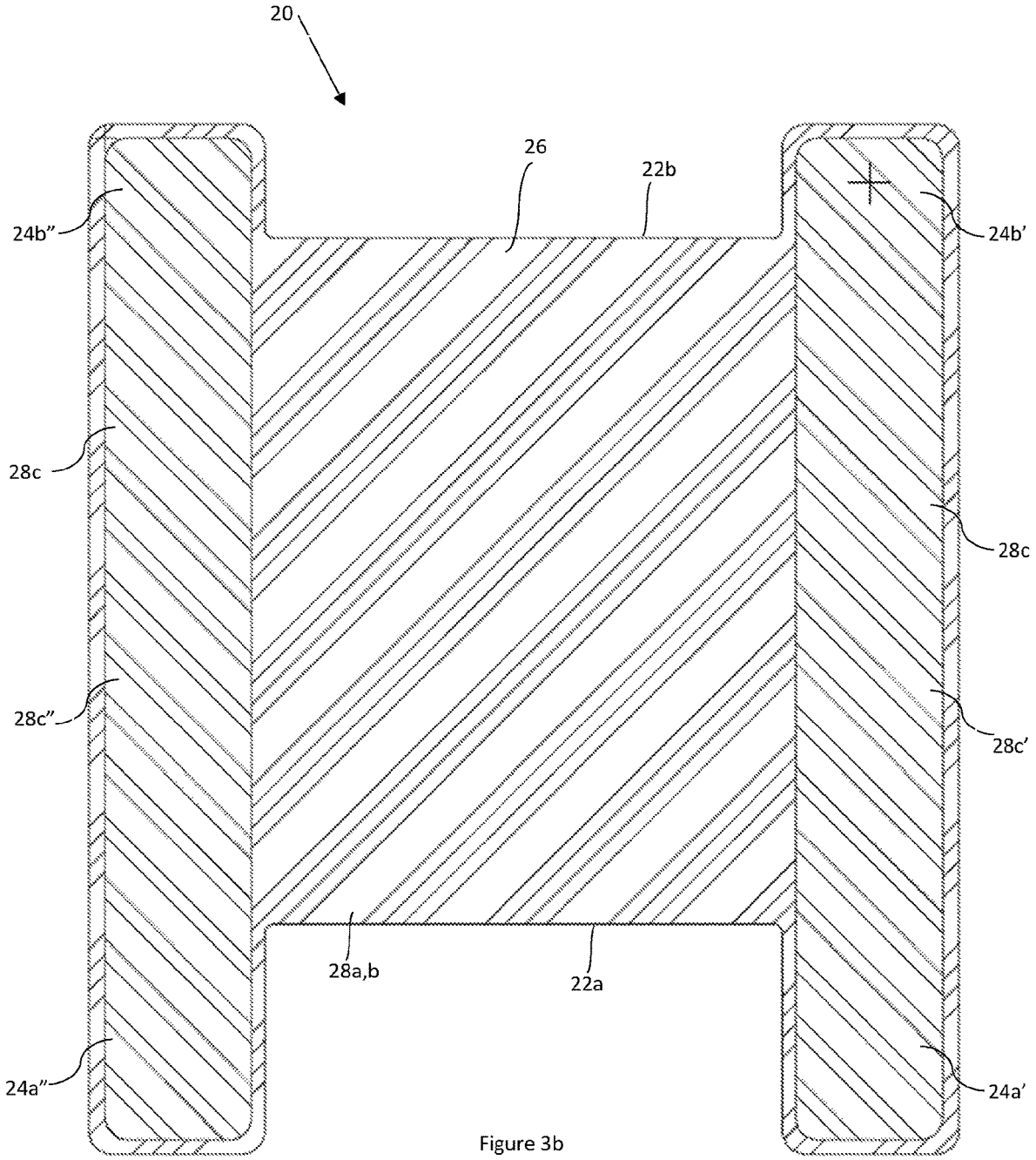
Figure 3C:
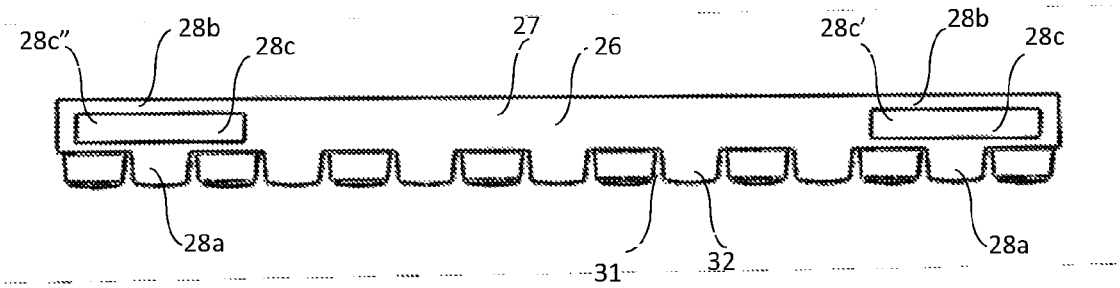

With reference to FIGS. 3*a*, 3*b* and 3*c*, one or more cross-sections of the pad 20 through its thickness comprises a first resilient layer 28*a*, a second resilient layer 28*b* and an intermediate rigid layer 28*c* provided between the first and second resilient layers. At other cross-sections the rigid layer 28*c* may not be provided. The second resilient layer 28*b* may face the rail 16 and in the particular example shown may directly receive the foot 17 of the rail. By contrast, the first resilient layer 28*a* may face the underlying foundation 18 and in the particular example shown the first resilient layer 28*a* may rest on the shim 58 (if provided).

The rigid layer 28*c* may be integrally formed with the first and second resilient layers 28*a*, 28*b*. In other words, the rigid layer 28*c* may be encapsulated, e.g. substantially or completely encapsulated, within the first and second resilient layers 28*a*, 28*b*. For example, the first and second resilient layers 28*a*, 28*b* may extend over one or more edges of the rigid layer 28*c* and the first and second resilient layers 28*a*, 28*b* may be connected at said edges of the rigid layer 28*c*. The first and second resilient layers may also be connected at one or more cross sections at which the rigid layer 28*c* is not provided, for example in the middle of the central region 26 away from the edges of the pad.

The first and second resilient layers 28*a*, 28*b* may be unitary with each other. The first and second resilient layers 28*a*, 28*b* may be made from the same material. The first and second resilient layers 28*a*, 28*b* may be molded around the rigid layer 28*c*. Additionally or alternatively, the first and second resilient layers 28*a*, 28*b* may be bonded to the rigid layer 28*c*.

The rigid layer 28*c* may be formed from a metal, such as steel. The first and second resilient layers 28*a*, 28*b* may be formed from the same resilient material, such as rubber.

The rigid layer 28*c* may extend beyond the width of the rail foot 17. For example, the rigid layer 28*c* may have a length greater than the width of a standard rail as described above. In particular, the rigid layer 28*a* may extend into the ears 24*a*', 24*a*"; 24*b*', 24*b*".

Figure 4:
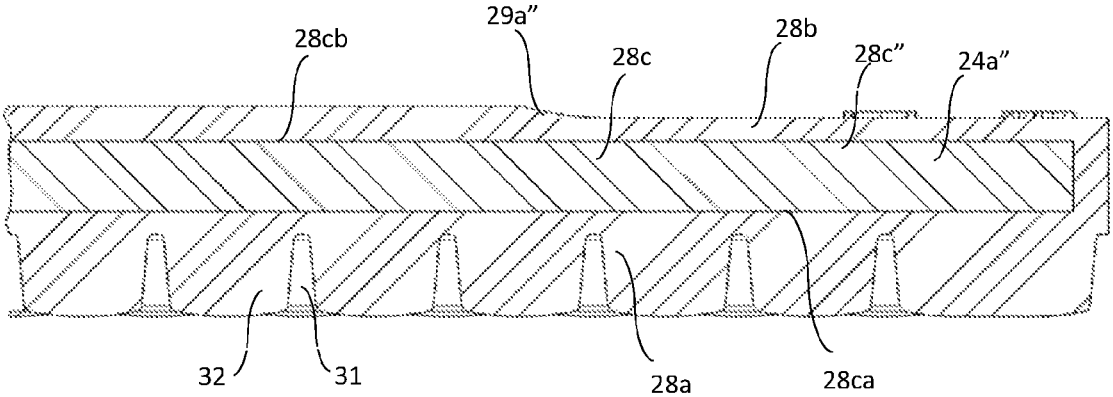
FIG. 4 shows a partial sectional view corresponding to section C-C depicted in FIG. 2*a* of the pad for the railway rail fastening assembly according to the first example of the present invention.

As is best depicted in FIGS. 3*c* and 4, the rigid layer 28*c* may have a substantially flat (e.g. flat) bottom surface 28*ca*. The bottom surface 28*ca* of the rigid layer 28*c* may face the first resilient layer 28*a*. As will be mentioned below, the thickness of the first resilient layer 28*a* may vary locally, however, the maximum thickness of the first resilient layer 28*a* may be substantially constant across the length of the pad. The rigid layer 28*c* may also have a substantially flat (e.g. flat) top surface 28*cb* that faces the second resilient layer 28*b*.

The rigid layer 28*c* may have a rigidity (e.g. stiffness) that resists bending of the rigid layer during use of the rail 16. For example, the rigid layer 28*c* may have a rigidity that limits the amount of rail roll as a lateral force is applied to the rail. The desired rigidity of the rigid layer 28*c* may be achieved by selecting the appropriate thickness, ear length, ear width and/or material for the rigid layer.

The rigid layer 28*c* may comprise first and second rigid layer portions 28*c*', 28*c*" laterally spaced apart from each other. The first and second rigid layer portions 28*c*', 28*c*" may be separate from one another so as to form discrete portions. In particular, the rigid layer 28*c* may be absent in a space 27 laterally between the first and second rigid layer portions 28*c*', 28*c*" where the rigid layer 28*c* may not otherwise protrude out beyond the rail width due to the presence of the anchoring devices 12 and side post insulators 24 in this region. In an alternative arrangement (not shown), the first and second rigid layer portions 28*c*', 28*c*" may be connected by a rigid connecting portion. In either case, the first and second rigid layer portions 28*c*', 28*c*" may be provided at the same intermediate position across the thickness of the pad 20.

As depicted in FIG. 3*b*, the first and second rigid layer portions 28*c*', 28*c*" may be elongate, e.g. forming strips, and extend in the longitudinal direction of the pad. In particular, respective ends of the first rigid layer portion 28*c*' may extend into corresponding ears 24*a*', 24*b*' and respective ends of the second rigid layer portion 28*c*" may extend into corresponding ears 24*a*", 24*b*". The first and second rigid layer portions 28*c*', 28*c*" may extend out almost to the ends of the ears, e.g. so that resistance to rail roll may be maximised. As depicted, the first and second resilient layers 28*a*, 28*b* may also extend out over the ears, although in an alternative arrangement (not shown) the first and/or second resilient layers may not extend over the ears.

The rigid layer 28*c* may reduce rail roll by extending out beyond the rail foot 17. Therefore, the cost may be reduced and the same effect achieved by providing the first and second rigid layer portions 28*c*', 28*c*", with no rigid layer present in the space 27 between the first and second rigid layer portions.

As depicted in FIGS. 2*a*, 3*a* and 4, the second resilient layer 28*b* may be thicker in the central region 26 than at the ears 24*a*', 24*a*", 24*b*', 24*b*". Transitions 29*a*', 29*a*", 29*b*', 29*b*" in the second resilient layer thickness may occur where the respective ears meet the central region 26 of the pad. For example, the second resilient layer thickness transition 29*a*', 29*a*", 29*b*', 29*b*" may extend in a direction parallel to and beneath an edge of the rail foot 17. A chamfer may be provided in the second resilient layer 28*b* where the thickness of the second resilient layer changes. The second resilient layer thickness transitions 29*a*', 29*a*", 29*b*', 29*b*" may avoid the edge of the rail foot 17 cutting in to the pad 20 as the rail rolls.

The first and second resilient layers 28*a*, 28*b* may be configured so as to have different stiffnesses, for example the second resilient layer 28*b* may be stiffer than the first resilient layer 28*a*. To achieve this the second resilient layer 28*b* may be thinner than the first resilient layer 28*a*. Additionally or alternatively, as best depicted in FIG. 4, the first resilient layer 28*a* may comprise a plurality of voids 31 distributed across the first resilient layer 28*a* so as to reduce the stiffness of the first resilient layer. The voids 31 reduce the area through which the loads from the rail 16 are distributed and thus reduce the stiffness.

The voids 31 are provided between a plurality of projections 32 which project away from the second resilient layer, e.g. in a vertical direction when the pad 20 is installed. As depicted, most of the projections 32 are circular in cross-section. The diameter of the circular cross-section may decrease with distance from the second resilient layer 28*b*. The projections 32 may also be arranged in rows which extend in the longitudinal direction of the pad. Neighbouring rows may be offset from one another. Non-circular cross-section projections 32 may be provided at the ends of rows, e.g. to provide projections up to the edges of the pad.

Figure 5A:
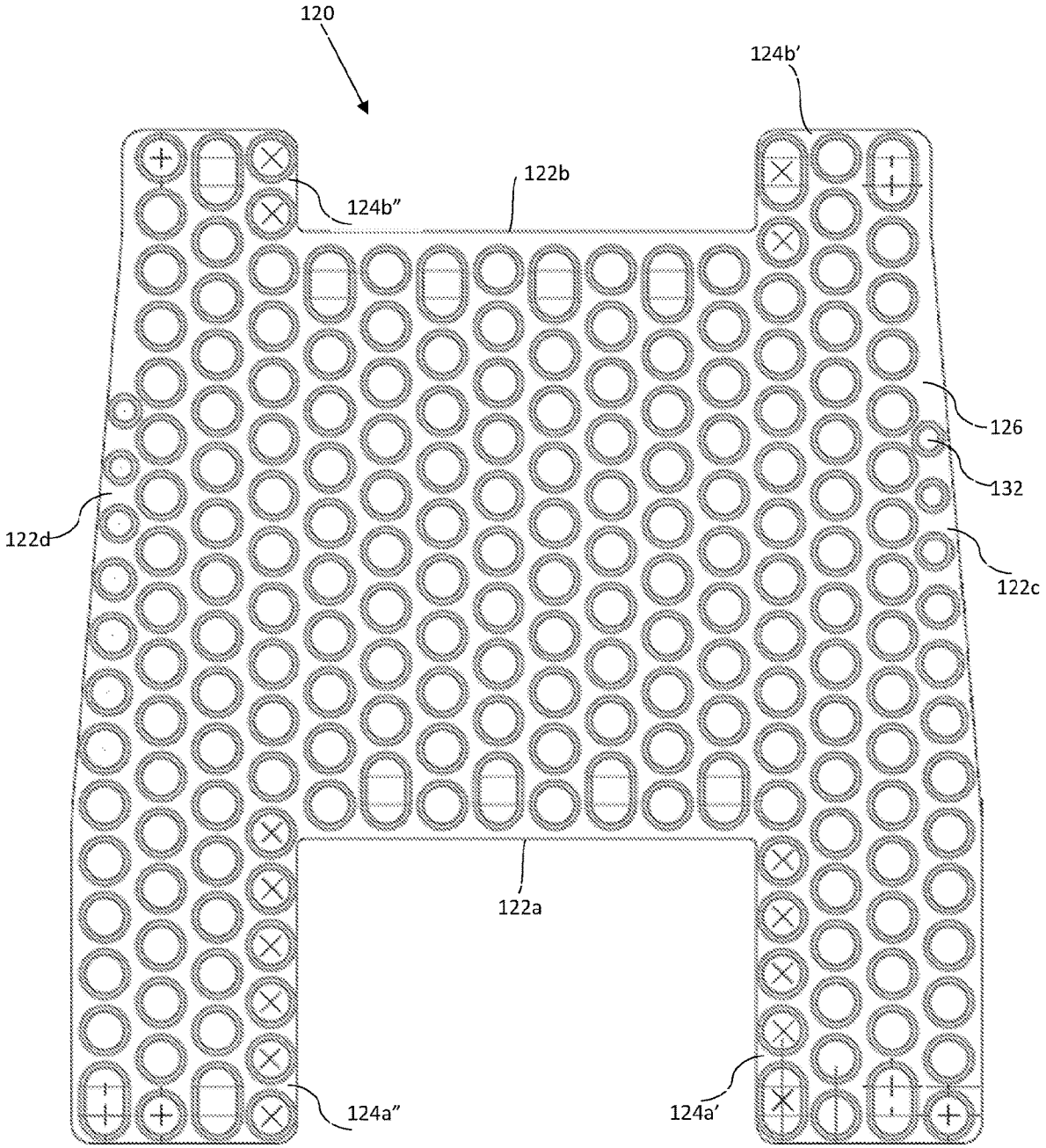
FIGS. 5*a* and 5*b* are plan views of a pad for the railway rail fastening assembly according to a second example of the present invention with FIGS. 5*a* and 5*b* showing bottom and top views respectively.
Figure 5B:
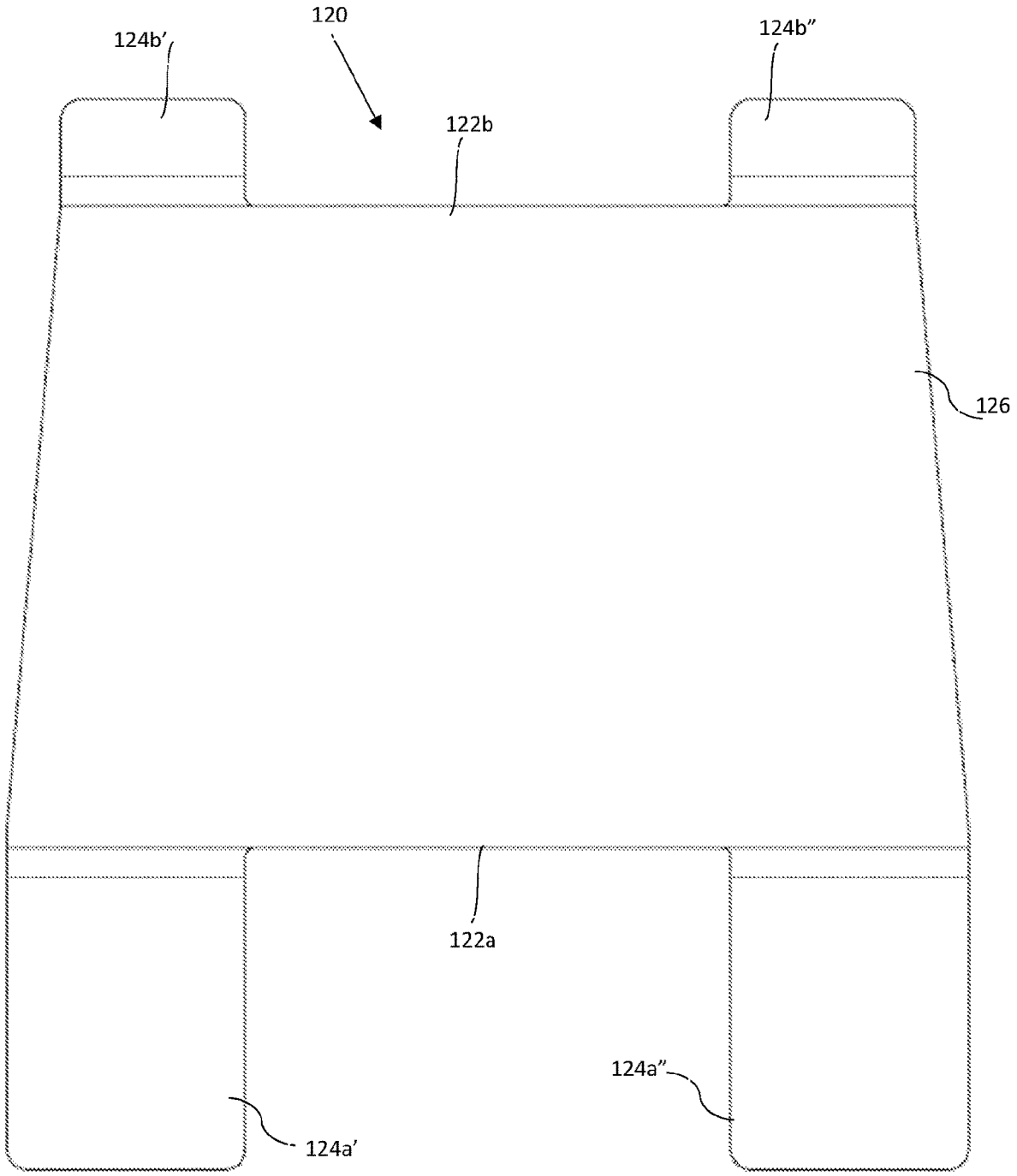
Figure 6:
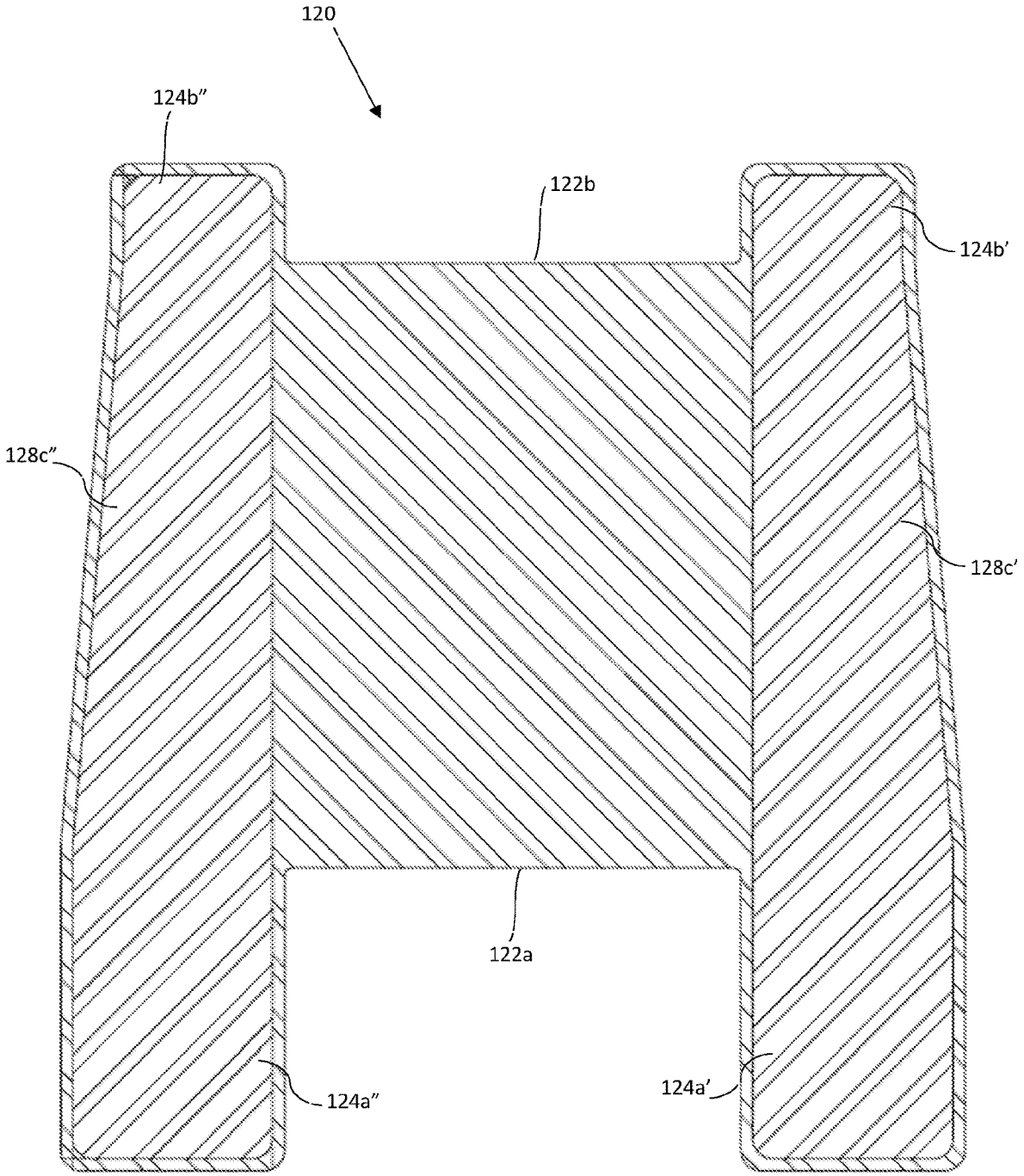
FIG. 6 shows a plan sectional view of the pad for the railway rail fastening assembly according to the second example of the present invention and corresponds to FIG. 3*b* for the first example.

With reference to FIGS. 5*a*, 5*b* and 6, a pad 120 according to a second example of the present invention will now be described. Except for the features described below, the pad 120 according to the second example is substantially the same as the pad 20 according to the first example and features described in respect of the first example may equally apply to the second example.

As depicted, the pair of ears 124*a*', 124*a*" on edge 122*a* may be wider (e.g. in the pad lateral direction) than the pair of ears 124*b*', 124*b*" on the opposite edge 122*b*. The wider ears 124*a*', 124*a*" may be provided on the field side of the pad 120 with the narrower ears 124*b*', 124*b*" being provided on the gauge side of the pad. The wider ears 124*a*', 124*a*" may also be longer than the ears 124*b*', 124*b*" provided on the opposite edge 122*b* in the same manner as that described in relation to the first example.

The longer and/or wider ears 24*a*', 24*a*"; 124*a*', 124*a*" may be more effective at resisting rail roll and as a result they may be provided on the field side of the pad, as this is where the maximum downward force may be directed. The length and/or width of the ears may be adjusted to suit the desired stiffness.

As depicted, the central region 126 may be trapezoidal shaped to provide the wider ears 124*a*', 124*a*". For example, a width of the central region from which the ears 124*a*', 124*a*" extend may be wider than the width of the central region from which the ears 124*b*', 124*b*" extend. The lateral spacing apart of the ears may otherwise be the same so as to accommodate the anchoring devices 12 which may be the same size.

As shown in FIG. 5*a*, first resilient layer projections 132 may be provided along the angled edges 122*c*, 122*d* of the trapezoidal shaped central section 126. The diameter of the projections' 132 cross-section may change along the edge of the trapezoidal shaped central section 126 to fit additional projections 132 into the central region.

FIG. 6 shows a cross-sectional view of the pad 120 corresponding to that shown in FIG. 3*b* for the pad 20. As depicted, each of the first and second rigid layer portions 128*c*', 128*c*" may be wider at one end than the other. In particular, the end of each of the first and second rigid layer portions 128*c*', 128*c*" that extends into the wider ears 124*a*', 124*a*" may be wider than the end that extends into the ears 124*b*', 124*b*".

In a further example of the present invention (not depicted) the second resilient layer may be omitted (or may be provided as a separate component). In such an example, the rigid layer 28*c*, 128*c* may be exposed on the side opposite the first resilient layer.

The pad without an integral second resilient layer may otherwise correspond to the pads described above. For example, the rigid layer may be molded with the first resilient layer and may be embedded within the first resilient layer. The rigid layer may comprises separate rigid layer portions as described above or may comprise a single portion, e.g. with the same plan view shape as the whole pad. Any of the other features described above in relation to the pads 20, 120 may apply to the pad without an integral second resilient layer.

In another example of the present invention (not depicted), the ears on one edge may be omitted, e.g. the ears on one edge may have zero length. For example, the pair of ears 24*a*', 24*a*"; 124*a*', 124*a*" on edge 22*a*; 122*a* may be omitted or the pair of ears 24*b*', 24*b*"; 124*b*', 124*b*" on the opposite edge 22*b*; 122*b* may be omitted. In either case, the ears may be provided on the field side of the pad (e.g. facing away from the opposite rail) as this is the side at which maximum downward force may be directed. The pad may be symmetrical about its longitudinal axis. As a result, the same pad may be used on either rail with the pad simply being rotated such that ears extend in the field direction. In this way only one type of pad needs to be provided.

Figure 7A:
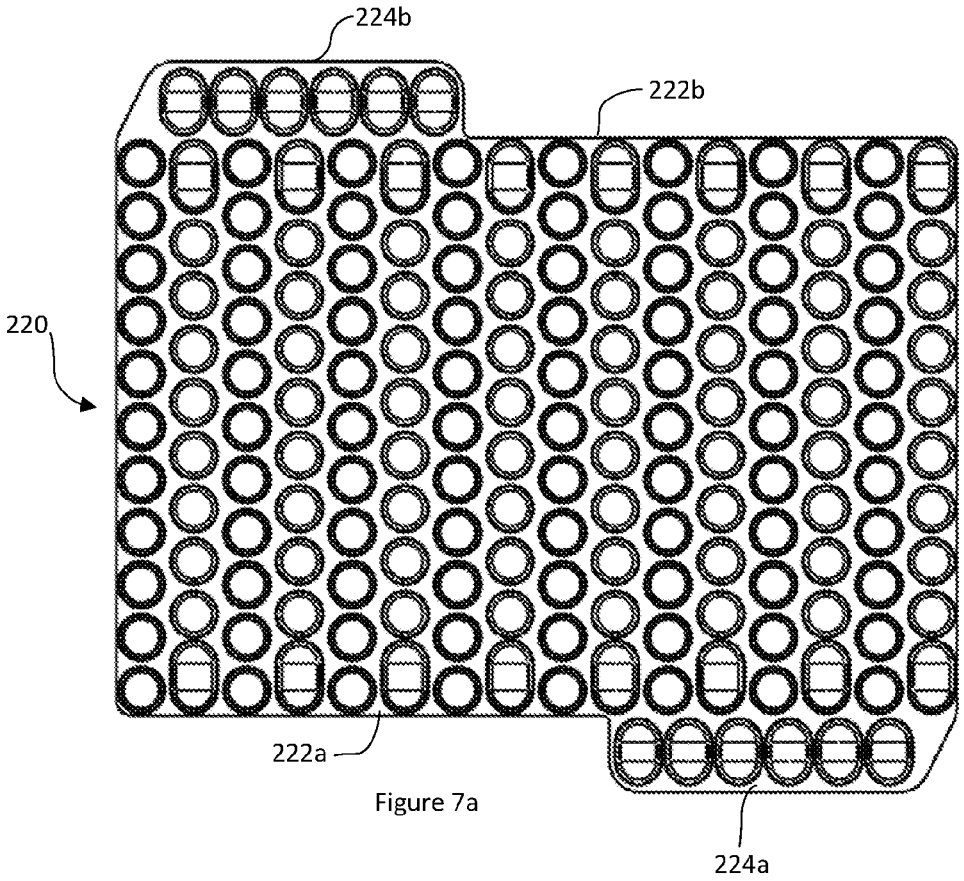
FIGS. 7*a*, 7*b* and 7*c* show a pad for the railway rail fastening assembly according to a third first example of the present invention with FIG. 7*a* showing a bottom plan view, FIG. 7*b* showing a top plan view and FIG. 7*c* showing a sectional view.
Figure 7B:
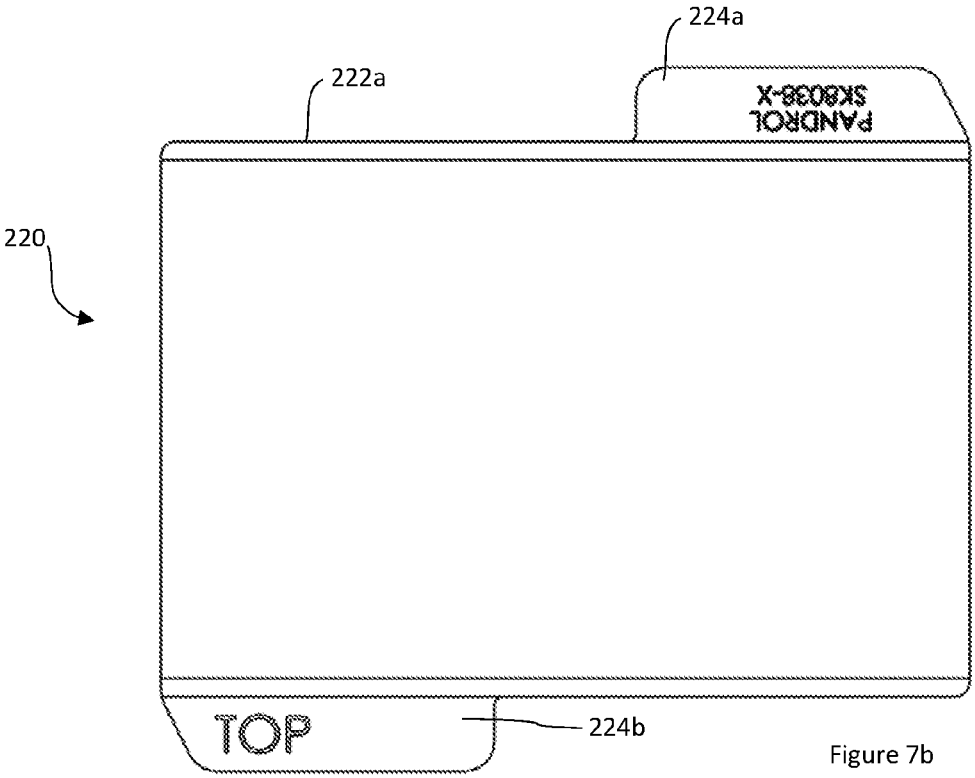
Figure 7C:
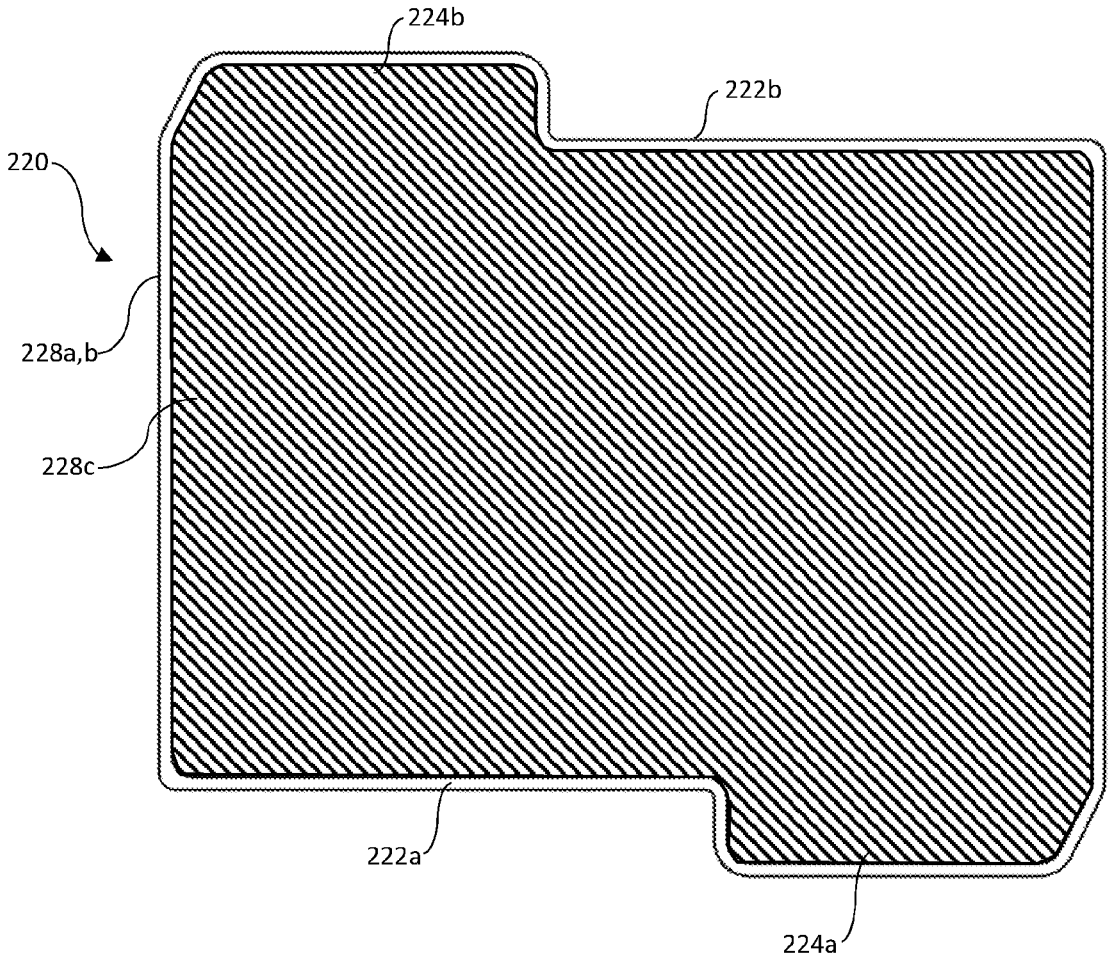

With reference to FIGS. 7*a*, 7*b* and 7*c*, a pad 220 according to a third example of the present invention will now be described. Except for the features described below, the pad 220 according to the third example is substantially the same as the pads 20, 120 according to the first and second examples and features described in respect of the first and second examples may equally apply to the third example.

As depicted, the edge 222*a* may comprise a single ear 224*a* and the opposing edge 222*b* may also comprise a single ear 224*b*. The ears 224*a*, 224*b* may be laterally offset from each other. The ears 224*a*, 224*b* may sit alongside offset anchoring devices. Accordingly, each ear 224*a*, 224*b* may be opposite an anchoring device.

The ears 224*a*, 224*b* may be the same size. Accordingly, the pad 220 may possess rotational symmetry about an axis perpendicular to the longitudinal and lateral axes of the pad, but may otherwise be axisymmetric about its longitudinal and lateral axes. In an alternative example (not depicted), the ears 224*a*, 224*b* may have different widths and/or lengths, e.g. in a manner similar to that described above for the first and second examples.

Referring to FIG. 7*c*, the rigid layer 228*c* may extend into each of the ears 224*a*, 224*b*. As depicted, the rigid layer 228*c* may be unitary. However, it is also envisaged that the rigid layer may be formed from separate portions, with each portion extending into a respective ear, e.g. in the manner described above for the first and second examples.

As for the first and second examples, the first and second resilient layers 228*a*, 228*b* may extend over one or more edges of the rigid layer 228*c* and the first and second resilient layers 228*a*, 228*b* may be connected at said edges of the rigid layer 228*c*.

In a further example (not depicted), one of the ears 224*a*, 224*b* may be omitted. The remaining ear may be provided on the field side of the pad as this is the side at which maximum downward force may be directed.

Figure 8:
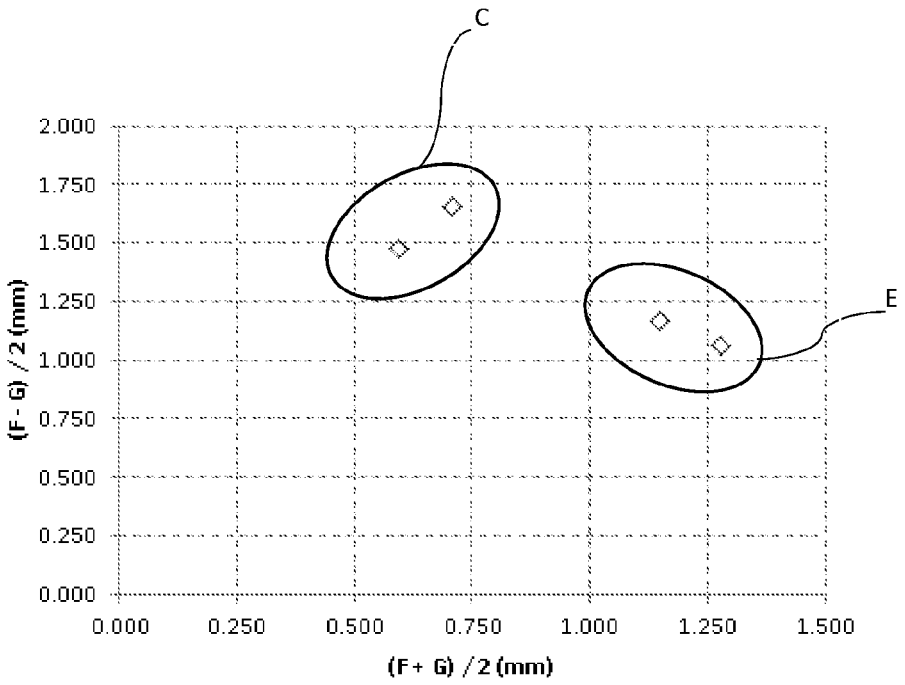
FIG. 8 shows a graph comparing the response to a static inclined load for previously-proposed pads and pads according to the present invention.

FIG. 8 shows a graph that illustrates the effectiveness of the pads according to the present invention. A static inclined load was applied to a rail fastening assembly with two conventional pads (C) and two pads (E) according to examples of the present invention. The load, angle, and height through which the load acts are those that would be applied dynamically in a standard European durability test on a fastening system. Measurements of the deflection of the rail foot rail on both the field (F) and gauge (G) sides of the assembly were taken. (The load is directed towards the field side, so the rail will almost inevitably deflect downwards on its field side.) Depending on the ability of the pad to resist roll, the rail may move downwards, not deflect much at all, or even move upwards on its gauge side. The average of the field and gauge side deflections, (F+G)/2, represents the downward component of rail movement, so that large downward movements indicate a soft pad (good in this context). The difference between the field and gauge side measurements, (F−G), is indicative of rail roll, which is undesirable. Plotting one against the other indicates performance of a pad: a combination of high average deflection and low deflection difference is good. FIG. 8 shows that the pads (E) according to examples of the present invention perform better than the conventional pads (C). The pads (E) according to the present invention provide more vertical deflection (lower stiffness) than the conventional pads (C), but also reduce rail roll despite the lower stiffness.

The invention claimed is:

1. A pad for a railway rail fastening assembly, the pad being configured for placement between a rail and an underlying foundation, wherein a cross-section of the pad comprises:

a rigid layer; and a first resilient layer configured to face the underlying foundation, wherein the rigid layer is integrally formed with the first resilient layer, wherein the first resilient layer defines at least one ear that extends beyond a central region of the pad, the rigid layer extending along an edge of the first resilient layer and into the ear to increase the rigidity of the ear and thereby resist rail roll, and wherein each ear is configured to extend alongside a substantial portion of an anchoring device forming part of the fastening assembly and the rigid layer extends from the central region along an edge of the first resilient layer and perpendicular to a longitudinal axis of the rail and has a rigidity that resists bending of the ear during use of the rail such that the ear limits the amount of rail roll as a lateral force is applied to the rail.

2. The pad of claim 1, wherein the pad further comprises a second resilient layer configured to face a railway rail, wherein the rigid layer is provided between and is integrally formed with the first and second resilient layers.

3. The pad of claim 2, wherein the first and second resilient layers extend over one or more edges of the rigid layer and the first and second resilient layers are connected at said edges of the rigid layer.

4. The pad of claim 2, wherein the first and second resilient layers are unitary with each other.

5. The pad of claim 2, wherein the first and second resilient layers are connected at one or more cross sections at which the rigid layer is not provided.

6. The pad of claim 2, wherein the first and second resilient layers are molded around the rigid layer.

7. The pad of claim 2, wherein the first and second resilient layers are configured so as to have different stiffnesses.

8. The pad of claim 7, wherein the second resilient layer is stiffer than the first resilient layer.

9. The pad of claim 1, wherein the first resilient layer and the rigid layer are molded together.

10. The pad of claim 1, wherein at least the rigid layer is sized so as to extend beyond the width of a base of the rail.

11. The pad of claim 1, wherein the rigid layer comprises first and second rigid layer portions that are separate and discrete portions spaced apart from each other such that the rigid layer is absent in a space laterally between the first and second rigid layer portions.

12. The pad of claim 1, wherein the edge comprises a pair of spaced apart ears that extend beyond the central region of the pad.

13. The pad of claim 12, wherein the rigid layer extends into each of the ears.

14. The pad of claim 1, wherein the edge and an opposing edge of the pad each comprise at least one ear that extends beyond the central region of the pad.

15. The pad of claim 14, wherein the edge and opposing edge each comprise one ear, the ears being diagonally opposite each other.

16. The pad of claim 14, wherein the opposing edge comprises a pair of spaced apart ears that extend beyond the central region of the pad.

17. The pad of claim 14, wherein the at least one ear on the edge extend further from the central region than the at least one ear on the opposing edge.

18. The pad of claim 14, wherein the at least one ear on the edge is wider than the at least one ear on the opposing edge.

19. The pad of claim 1, wherein the central region is trapezoidal shaped with a width of the central region from which the at least one ear extends being wider than an opposite width of the central region.

20. The pad of claim 1, wherein a length of the rigid layer is greater than a width of the rail.

* * * * *